US008387807B2

(12) United States Patent
Chen et al.

(10) Patent No.: US 8,387,807 B2
(45) Date of Patent: Mar. 5, 2013

(54) MODULAR ORGANIZER FOR CRIB OR PLAYPEN

(75) Inventors: Shun-Min Chen, Taipei (TW); Jian-Qun Li, Taipei (TW)

(73) Assignee: Wonderland Nursery Goods, Co. Ltd., Taipei (TW)

( * ) Notice: Subject to any disclaimer, the term of this patent is extended or adjusted under 35 U.S.C. 154(b) by 161 days.

(21) Appl. No.: 12/722,029

(22) Filed: Mar. 11, 2010

(65) Prior Publication Data

US 2010/0162487 A1 Jul. 1, 2010

Related U.S. Application Data

(62) Division of application No. 11/452,658, filed on Jun. 13, 2006, now abandoned.

(51) Int. Cl.
*A47G 29/087* (2006.01)
*F16M 11/00* (2006.01)

(52) U.S. Cl. ..... 211/88.01; 211/119.006; 248/690; 5/93.1; 5/503.1

(58) Field of Classification Search ..... 211/85.29, 211/88.01, 90.01, 119.006, 134, 309.1; 248/304, 248/307, 309.1, 311.2, 316.6, 322, 339, 690; 5/93.1, 503.1, 507.1; 224/269, 407, 409, 224/678, 682; 403/381
See application file for complete search history.

(56) References Cited

U.S. PATENT DOCUMENTS

| | | | | |
|---|---|---|---|---|
| 387,095 | A | 7/1888 | McPherson | 217/7 |
| 608,523 | A | 8/1898 | Lucas | 5/95 |
| 890,693 | A | 6/1908 | McCoy | 248/213.2 |
| 932,236 | A | 8/1909 | Appleton | 211/119.006 |
| 1,440,906 | A | 1/1923 | Bouza | 248/454 |
| 1,525,928 | A | 2/1925 | Fitch | 297/163 |
| 2,521,572 | A | 9/1950 | Eckel et al. | 312/243 |
| 2,686,702 | A | 8/1954 | Ventrice | 108/6 |
| 2,735,597 | A | 2/1956 | Treleven | 224/312 |
| 3,193,108 | A | 7/1965 | Johnson | 211/153 |
| 3,289,615 | A | 12/1966 | Marschak | 108/97 |
| 3,477,679 | A | 11/1969 | Lovitz | 248/213.2 |
| 3,842,981 | A | 10/1974 | Labert | 211/74 |
| 4,046,452 | A * | 9/1977 | Cassarly | 439/594 |
| 4,184,618 | A * | 1/1980 | Jones | 224/407 |
| 4,483,626 | A * | 11/1984 | Noble | 368/10 |
| 4,667,277 | A * | 5/1987 | Hanchar | 362/249.01 |
| 4,918,576 | A * | 4/1990 | Farrall et al. | 362/11 |
| 5,531,238 | A * | 7/1996 | Azzarelli et al. | 135/66 |
| 5,636,682 | A * | 6/1997 | Wolf | 165/41 |
| 5,813,064 | A | 9/1998 | Hartenstine | 5/99.1 |
| 5,901,891 | A * | 5/1999 | Douglass | 224/407 |
| 6,823,998 | B2 * | 11/2004 | Fabregas | 211/70.6 |
| 6,952,849 | B2 | 10/2005 | Pacella | 5/658 |
| 7,043,778 | B1 * | 5/2006 | Georgitsis et al. | 5/93.1 |
| 7,204,465 | B2 * | 4/2007 | Cheng | 248/311.2 |
| 2004/0187212 | A1 * | 9/2004 | Pacella | 5/503.1 |
| 2006/0226191 | A1 * | 10/2006 | Williams | 224/409 |

* cited by examiner

*Primary Examiner* — Jonathan Liu
*Assistant Examiner* — Joshua Rodden
(74) *Attorney, Agent, or Firm* — Ladas & Parry, LLP

(57) ABSTRACT

A modular organizer is capable of attachment to a rod of a playpen or crib, and includes first and second storage members that are connected removably to each other. Each of the first and second storage members is attached to the rod by a positioning element. Preferably, one or more third storage members are disposed between and connected removably to the first and second storage members. The third storage members can be interconnected removably to one another and to the first and second storage members.

11 Claims, 7 Drawing Sheets

MODULAR ORGANIZER FOR CRIB OR PLAYPEN

CROSS-REFERENCE TO RELATED APPLICATIONS

This application is a divisional of U.S. patent application Ser. No. 11/452,658, filed on Jun. 13, 2006, and published as U.S. Patent Application Publication No. 2008/0000857 A1, the disclosure of which is hereby incorporated by reference in its entirety.

BACKGROUND OF THE INVENTION

1. Field of the Invention

This invention relates to a storage device, and more particularly to a modular organizer for a crib or a playpen.

2. Description of the Related Art

U.S. Pat. No. 5,813,064 discloses a portable playard storage system. U.S. Pat. No. 6,952,849 discloses an organizer for a playard. Each of the playard storage system and the organizer includes a plurality of storage members. Because the storage members are interconnected fixedly, the number of the storage members cannot be changed, thereby resulting in inconvenience during use.

SUMMARY OF THE INVENTION

The object of this invention is to provide a modular organizer for a crib or playpen, which includes a plurality of storage members that are interconnected removably so as to allow for a change to the number and shape of the storage members.

A modular organizer is adapted for attachment to a rod of a playpen or crib, and includes first and second storage members that are connected removably to each other. Each of the first and second storage members is attached to the rod by a positioning element. Preferably, one or more third storage members are disposed between and connected removably to the first and second storage members. The third storage members are interconnected removably.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
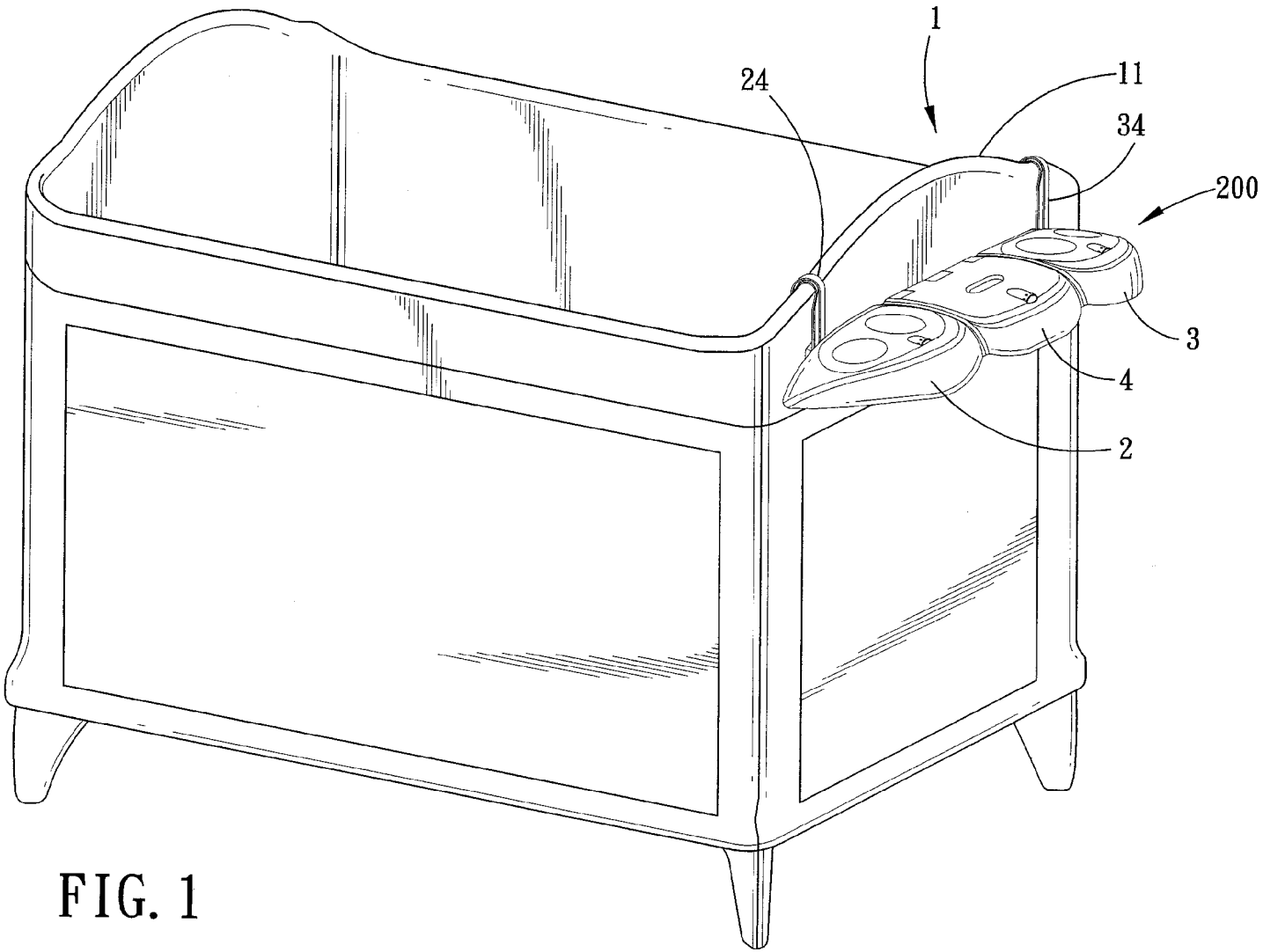
FIG. 1 is a perspective top view of the first preferred embodiment of a modular organizer for a playpen according to this invention, illustrating the modular organizer in a state mounted to a playpen.
Figure 2:
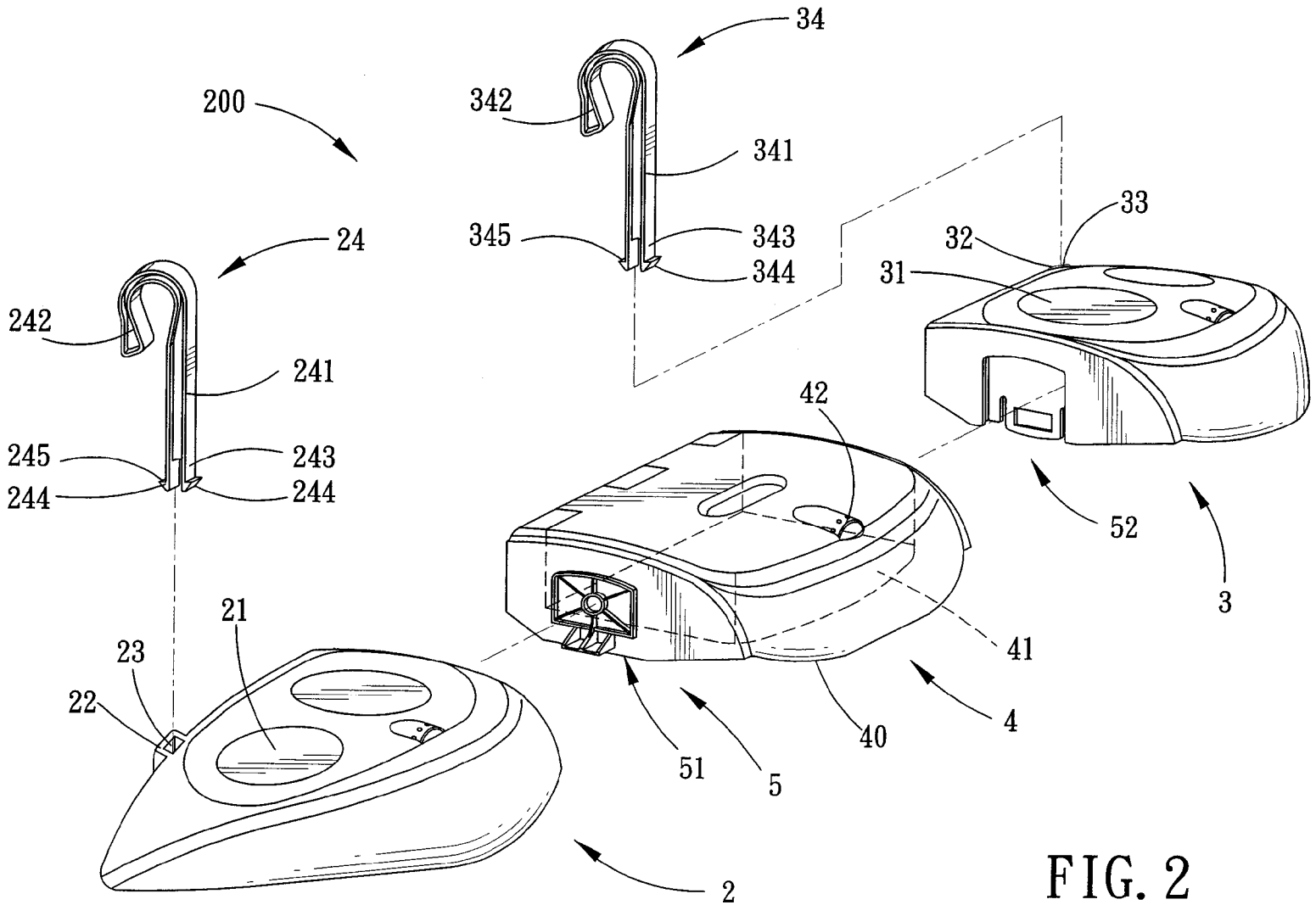
FIG. 2 is an exploded perspective top view of the first preferred embodiment.
Figure 3:
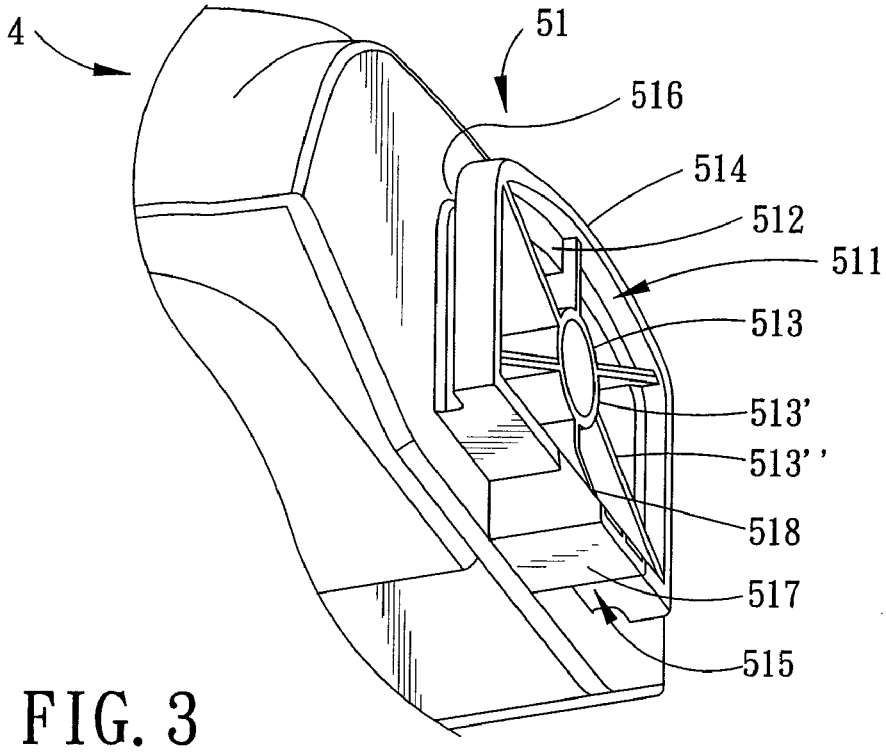
FIG. 3 is a fragmentary perspective bottom view of a third storage member of the first preferred embodiment.
Figure 4:
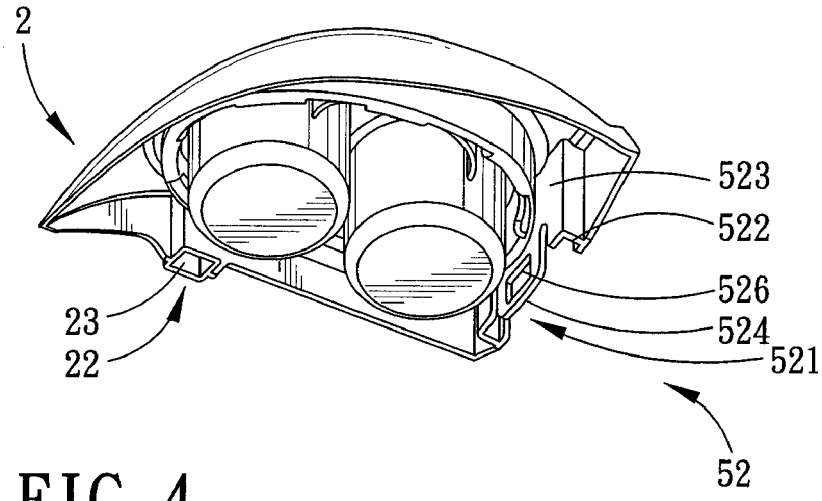
FIG. 4 is a fragmentary perspective bottom view of a first storage member of the first preferred embodiment.
Figure 5:
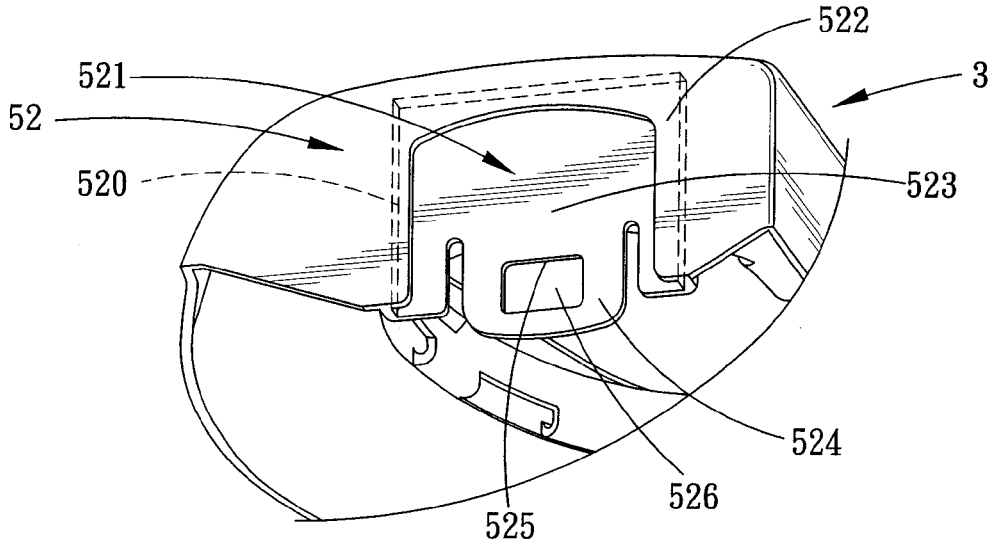
FIG. 5 is a fragmentary perspective side view of a second storage member of the first preferred embodiment.
Figure 6:
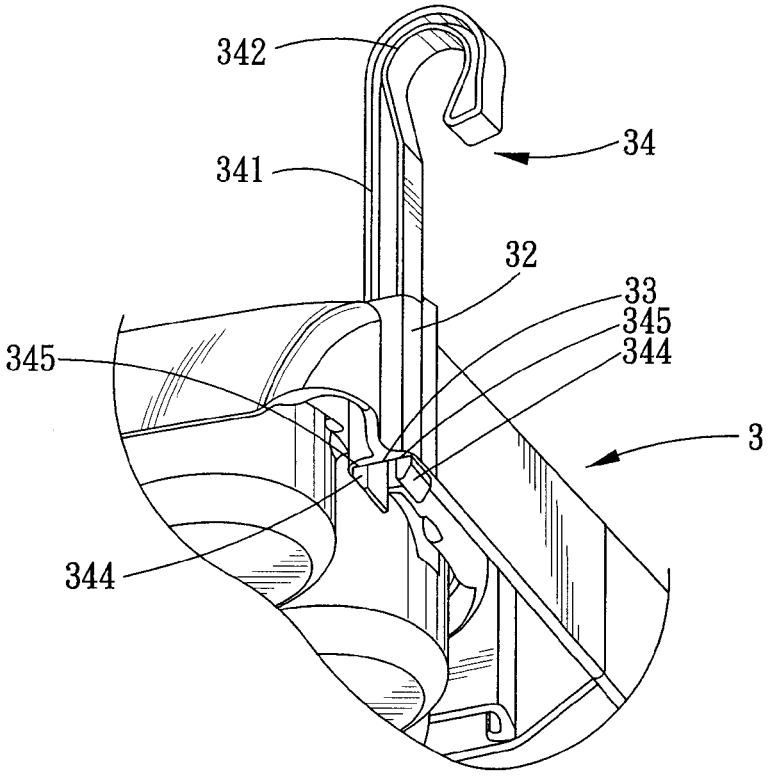
FIG. 6 is a fragmentary assembled perspective bottom view of the second storage member and a second positioning element of the first preferred embodiment.

Before the present invention is described in greater detail in connection with the preferred embodiments, it should be noted that similar elements and structures are designated by like reference numerals throughout the entire disclosure.

Referring to FIGS. 1 to 7, the first preferred embodiment of a modular organizer 200 according to this invention is adapted to be attached to a curved top rod 11 of a playpen 1. Alternatively, the modular organizer 200 may be used with a crib. The organizer 200 includes a horizontal row of first, second, and third storage members 2, 3, 4, first and second positioning elements 24, 34, and two joining mechanisms 5. The first, second, and third storage members 2, 3, 4, as well as the first and second positioning elements 24, 34 are made of plastic. Each of the first, second, and third storage members 2, 3, 4 has a rear side surface facing the playpen 1.

The third storage member 4 is disposed between the first and second storage members 2, 3. The first and second positioning elements 24, 34 are disposed respectively on the first and second storage members 2, 3, and are attached to the rod 11. One of the joining mechanisms 5 is disposed within a gap defined by the first and third storage members 2, 4 so as to interconnect the same removably. The other of the joining mechanisms 5 is disposed within a gap defined by the second and third storage members 3, 4 so as to interconnect the same removably.

The third storage member 4 is generally rectangular, and includes a bowl-shaped container body 40 defining a rectangular accommodating chamber 41 therein, and an openable top cover 42 disposed pivotally on the container body 40 for covering the accommodating chamber 41. Each of the first and second storage members 2, 3 has a top surface that is formed with two circular blind holes 21, 31.

Each of the first and second storage members 2, 3 has a sleeve portion 22, 32 formed on the rear side surface thereof and formed with a rectangular hole 23, 33. The first and second positioning elements 24, 34 extend respectively through the holes 23, 33 in the sleeve portions 22, 32 of the first and second storage members 2, 3.

Each of the first and second positioning elements 24, 34 has an elongated vertical rod body 241, 341, an inverted U-shaped retaining hook portion 242, 342 connected to an upper end of the rod body 241, 341, and a lower end connected to a lower end of the rod body 241, 341 and formed with two resilient arms 243, 343 in a two-pronged configuration. The retaining hook portions 242, 342 engage the rod 11 of the playpen 1 such that movement of the first, second, and third storage members 2, 3, 4 relative to the rod 11 is prevented. Each of the resilient arms 243, 343 has a retaining portion 244, 344, and is configured as a barb that has a horizontal abutment surface 245, 345. The abutment surfaces 245, 345 abut respectively against bottom surfaces of the sleeve portions 22, 32 of the first and second storage members 2, 3. This prevents movement of the retaining portions 244, 344 through the sleeve portions 22, 32 and, thus, removal of the first and second storage members 2, 3 from the first and second positioning elements 24, 34. For each of the first and second positioning elements 24, 34, the retaining portions 244, 344 can be pushed toward each other to allow for movement of a corresponding one of the first and second positioning elements 24, 34 through the corresponding sleeve portion 22, 32 of the first and second storage members 2, 3.

Each of the joining mechanisms 5 includes a first joining unit 51 and a second joining unit 52. The first joining units 51 are disposed respectively on opposite lateral side surfaces (i.e., left and right side surfaces) of the third storage member 4. The second joining units 52 are disposed respectively at the first and second storage members 2, 3. Each of the first joining units 51 includes a hollow dovetail tongue 511 having a T-shaped cross section and formed integrally with the third storage member 4. Each of the dovetail tongues 511 has an annular narrow tongue portion 512, an inner reinforcing rib 513, and an annular wide tongue portion 514. Each of the narrow tongue portions 512 and the inner reinforcing ribs 513 is formed on the corresponding lateral side surface of the third storage member 4. Each of the inner reinforcing ribs 513 has a central ring-shaped rib portion 513', and a plurality of radial rib portion 513". Each of the radial rib portions 513" has a radial inner end formed integrally with the corresponding central ring-shaped rib portion 513', and a radial outer end formed integrally with the corresponding narrow tongue portion 512 and the corresponding wide tongue portion 514. Each of the wide tongue portions 514 has an inverted U-shaped outer peripheral portion extending outwardly from the corresponding narrow tongue portion 512 so as to define an inverted U-shaped groove 516 between the corresponding wide tongue portion 514 and the corresponding lateral side surface of the third storage member 4. Each of the first joining units 51 further includes a hollow positioning tongue 515 disposed under the corresponding dovetail tongue 511 and formed integrally with the corresponding dovetail tongue 511 and the corresponding lateral side surface of the third storage member 4. Each of the positioning tongues 515 has a horizontal first contact surface (i.e., bottom surface) 517 and an inclined second contact surface 518.

Each of the second joining units 52 includes a dovetail groove 521 formed in a corresponding one of the first and second storage members 2, 3 and engaging fittingly the corresponding dovetail tongue 511. Each of the dovetail grooves 521 is defined by an inverted U-shaped plate portion 522 and a tongue groove-defining wall 523 of the corresponding one of the first and second storage members 2, 3, between which an inverted U-shaped accommodating space 520 is formed. The groove-defining walls 523 define respectively bottoms of the dovetail grooves 521. The inverted U-shaped plate portions 522 of the first and second storage members 2, 3 are disposed respectively around the wide tongue portions 514 of the dovetail tongues 511 of the third storage member 4. The inverted U-shaped outer peripheral portions of the wide tongue portions 514 of the dovetail tongues 511 are fitted respectively within the inverted U-shaped accommodating spaces 520.

Figure 7:
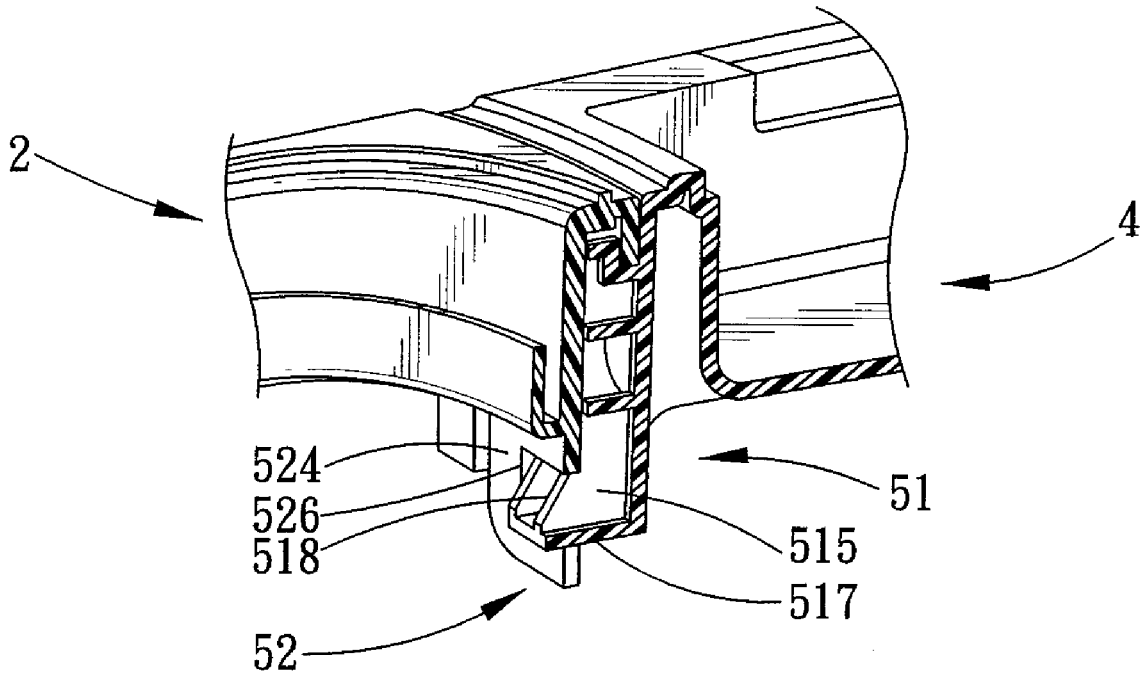
FIG. 7 a fragmentary, partly sectional, assembled perspective top view of the first and third storage members of the first preferred embodiment.

Each of the second joining units 52 further includes a resilient plate 524 extending integrally and downwardly from the corresponding groove bottom-defining wall 523 and formed with a rectangular hole 526 therethrough. The positioning tongues 515 of the third storage member 4 engage respectively the holes 526 in the resilient plates 524. Each of the resilient plates 524 has a hole-defining wall 525 defining the corresponding hole 526. The horizontal first contact surfaces 517 of the positioning tongues 515 of the third storage member 4 abut respectively against lower ends of the hole-defining walls 525 of the resilient plates 524, and the inclined second contact surfaces 518 of the positioning tongues 515 of the third storage member 4 abut respectively against upper ends of the hole-defining walls 525 of the resilient plates 524, as shown in FIG. 7.

Since the first and second storage members 2, 3 are made of a plastic material, when the dovetail tongues 511 of the third storage member 4 are inserted vertically into the dovetail grooves 521 in the first and second storage members 2, 3 during assembly, the resilient plates 524 deform so as to allow for movement of the positioning tongues 515 into the holes 526 in the resilient plates 524. When the horizontal first contact surfaces 517 of the positioning tongues 515 come into contact with the lower ends of the hole-defining walls 525 of the resilient plates 524, removal of the dovetail tongues 511 from the dovetail grooves 521 is prevented.

When it is desired to remove the first and second storage members 2, 3 from the third storage member 4, the resilient plates 524 are pushed away from the third storage member 4 so as to separate the positioning tongues 515 from the holes 526 in the resilient plates 524. Subsequently, the dovetail tongues 511 are separated from the dovetail grooves 521.

As such, the modular organizer 200 can be assembled and disassembled with ease. Furthermore, this configuration allows for an adjustment to the number of the storage members 2, 3, 4. Thus, the object of this invention can be achieved.

Figure 8:
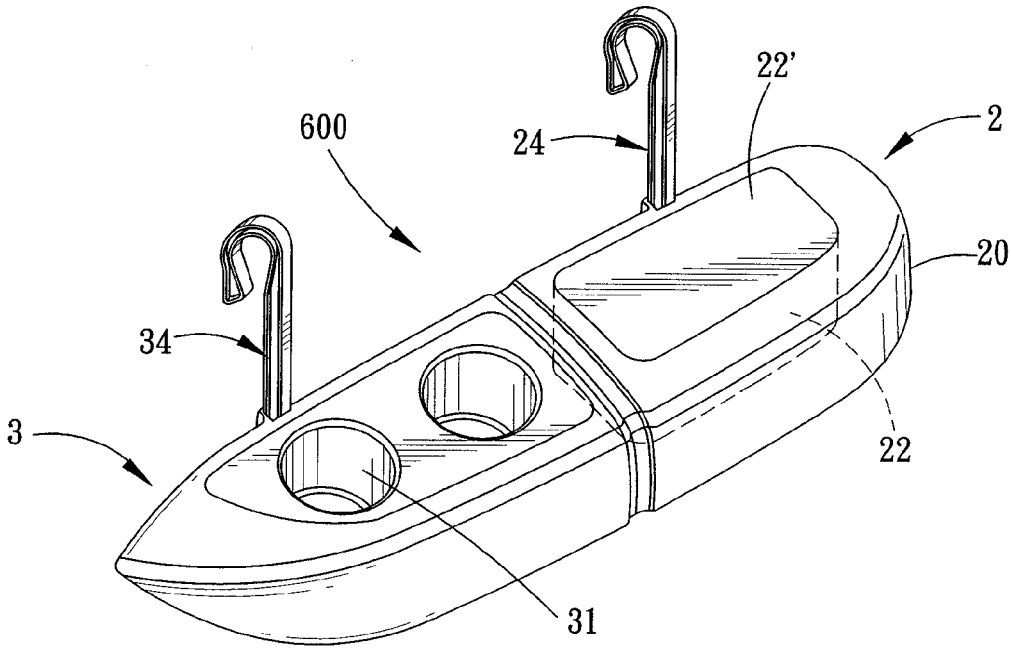
FIG. 8 is a perspective top view of the second preferred embodiment of a modular organizer for a playpen according to this invention.
Figure 9:
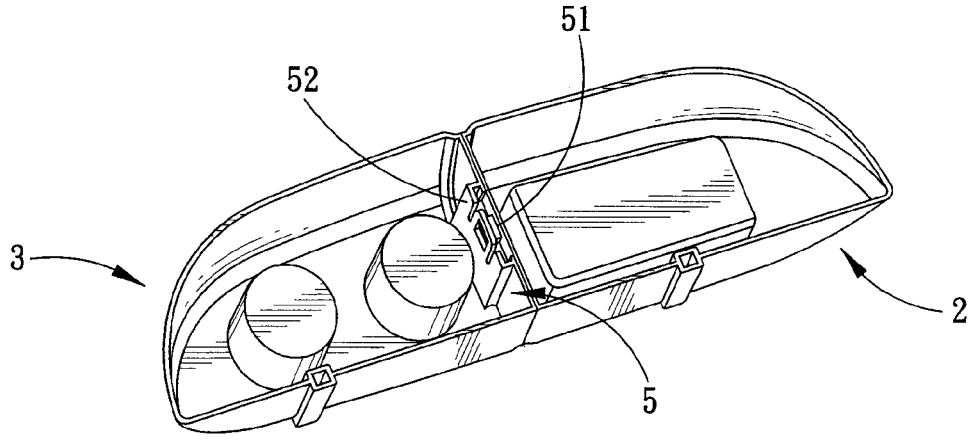
FIG. 9 is a perspective bottom view of first and second storage members of the second preferred embodiment.

Referring to FIGS. 8 and 9, the second preferred embodiment of a modular organizer 600 according to this invention includes first and second storage members 2, 3, first and second positioning elements 24, 34, and a joining mechanism 5. The joining mechanism 5 consists of first and second joining units 51, 52 that are disposed respectively at the first and second storage members 2, 3. The first storage member 2 includes a bowl-shaped container body 20 defining a generally rectangular accommodating chamber 22, and an openable top cover 22' disposed pivotally on the container body 20 for covering the accommodating chamber 22, and is connected removably to the second storage member 3 by the joining mechanism 5. The second storage member 3 has a top surface that is formed with two circular blind holes 31. The first and second positioning elements 24, 34 are similar in construction to those of the first preferred embodiment, and are connected respectively to the first and second storage members 2, 3 in the same manner as in the first preferred embodiment. The structures of the first and second joining units 51, 52 are also similar to those of the first preferred embodiment.

Figure 10:
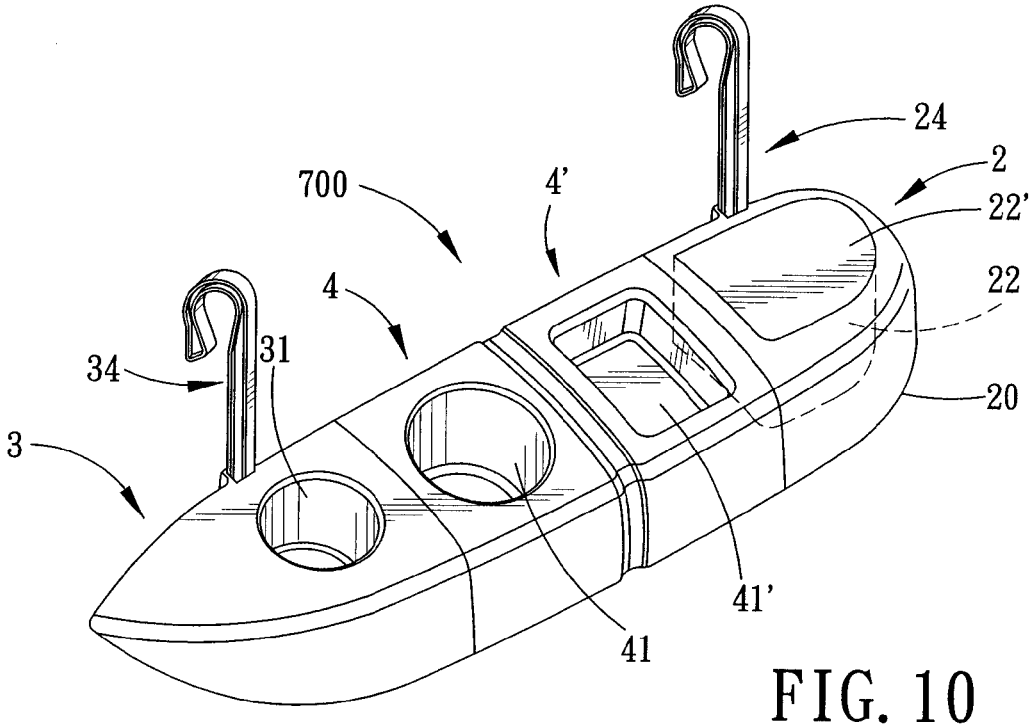
FIG. 10 is a perspective top view of the third preferred embodiment of a modular organizer for a playpen according to this invention.
Figure 11:
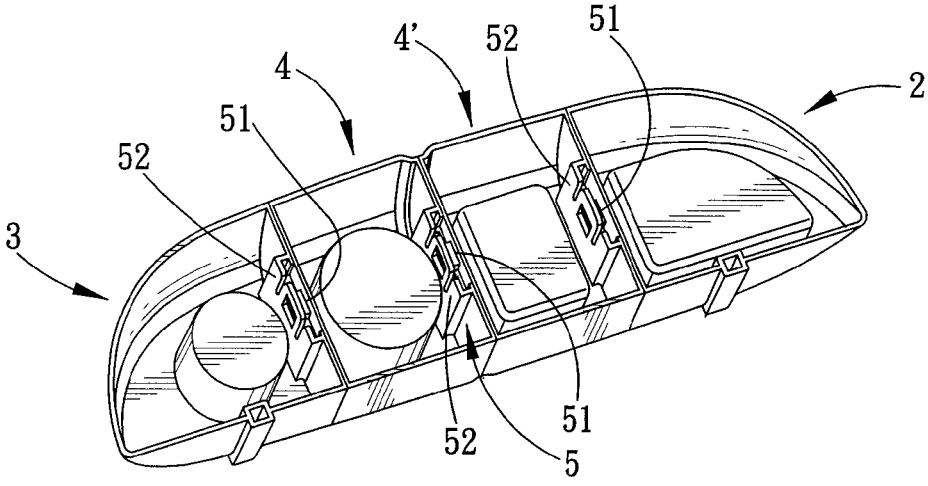
FIG. 11 is a perspective bottom view of first, second, third, and fourth storage members of the third preferred embodiment.

Referring to FIGS. 10 and 11, the third preferred embodiment of a modular organizer 700 according to this invention includes a first storage member 2, a second storage member 3, left and right third storage members 4, 4', first and second positioning elements 24, 34, and third joining mechanisms 5. The left and right third storage members 4, 4' are disposed between the first and second storage members 2, 3. Each adjacent pair of the first, second, and third storage members 2, 3, 4, 4' is interconnected removably by the corresponding joining mechanism 5. The first, second, and third storage members 2, 3, 4, 4' are arranged in a horizontal row. Each of the second storage member 3 and the left third storage member 4 has a top surface that is formed with a blind hole 31, 41. The first storage member 2 includes a container body 20 defining an accommodating chamber 22, and an openable top cover 22' disposed pivotally on the container body 20 for covering the accommodating chamber 22. The right third storage member 4' is formed with an accommodating chamber 41'. The first and second positioning elements 24, 34 are similar in construction to those of the first preferred embodiment, and are connected respectively to the first and second storage members 2, 3 in the same manner as in the first preferred embodiment. Each of the joining mechanisms 5 includes first and second joining units 51, 52. The first joining units 51 are similar in construction to those of the first preferred embodiment, and are disposed respectively at left side surfaces of the first storage member 2 and the left and right third storage members 4, 4'. The second joining units 52 are similar in construction to those of the first preferred embodiment, and are disposed respectively at right side surfaces of the left and right third storage members 4, 4' and the second storage member 3.

With this invention thus explained, it is apparent that numerous modifications and variations can be made without departing from the scope and spirit of this invention. It is therefore intended that this invention be limited only as indicated by the appended claims.

What is claimed:

1. A modular organizer adapted to be attached to a rod of a playpen, said organizer comprising:

a row of storage members, each adjacent pair of said storage members defining a gap therebetween;

first and second positioning elements disposed respectively on two of said storage members, each of said first and second positioning elements having a retaining hook portion at an upper end thereof, which is adapted to be removably connected with the rod, and a third one of said storage members being positioned between said two of said storage members; and a plurality of joining mechanisms disposed respectively within said gaps, each of said joining mechanisms including first and second joining units that are disposed respectively at a corresponding adjacent pair of said storage members and that engage each other so as to interconnect the corresponding adjacent pair of said storage members removably;

wherein a first storage member of said two of said storage members has a first extension extending there from and a second storage member of said two of said storage members has a first groove formed therein, said first extension being sized to engage said first groove to removably connect said first and second storage members;

wherein said third storage member has a second extension extending there from and a second groove formed therein, said first extension being sized to engage said second groove to removably connect said first and third storage members, and said second extension being sized to engage said first groove to removably connect said second and third storage members;

wherein said first joining unit of each of said joining mechanisms includes a corresponding one of said first and second extensions;

wherein said second joining unit of each of said joining mechanisms includes a corresponding one of said first and second grooves;

wherein each of said first and second extensions is a dovetail tongue extending from a corresponding one of said storage members, and each of said first and second grooves is a dovetail groove formed in a corresponding one of said storage members and engaging fittingly a corresponding one of said dovetail tongues; and wherein each of said dovetail grooves is defined by an inverted U-shaped plate portion and a groove bottom-defining wall of the corresponding one of said storage members, between which an inverted U-shaped accommodating space is formed, each of said inverted U-shaped accommodating spaces being adapted to be disposed respectively around a corresponding one of said dovetail tongues, each of said dovetail tongues having an inverted U-shaped outer peripheral portion fitted within a corresponding one of said inverted U-shaped accommodating spaces.

2. The modular organizer as claimed in claim 1, wherein each of said dovetail tongues has a T-shaped cross section so as to define an inverted U-shaped groove between a corresponding one of said storage members and a corresponding one of said dovetail tongues.

3. The modular organizer as claimed in claim 1, wherein each of said first joining units further includes a positioning tongue extending from a corresponding one of said storage members and disposed under a corresponding one of said dovetail tongues; each of said second joining units further including a resilient plate extending downwardly from said groove bottom-defining wall and formed with a hole therethrough, said positioning tongues engaging respectively said holes in said resilient plates.

4. The modular organizer as claimed in claim 1 wherein each of said dovetail tongues is formed integrally with a corresponding one of said storage members.

5. The modular organizer as claimed in claim 3, wherein said resilient plates are formed respectively and integrally with said groove bottom-defining walls.

6. The modular organizer as claimed in claim 3, wherein each of said resilient plates has a hole-defining wall defining a corresponding one of said holes in said resilient plates; and each of said positioning tongues has a horizontal first contact surface abutting against a lower end of a corresponding one of said hole-defining walls of said resilient plates, and an inclined second contact surface abutting against an upper end of the corresponding one of said hole-defining walls of said resilient plates.

7. The modular organizer as claimed in claim 3, wherein each of said two of said storage members has a sleeve portion, said first and second positioning elements extending respectively through said sleeve portions of a corresponding one of said two of said storage members.

8. The modular organizer as claimed in claim 7, wherein each of said first and second positioning elements has a lower end formed with two resilient arms, each of which has a retaining portion that is shaped so as to prevent movement of a corresponding one of said first and second positioning elements through said sleeve portion of a corresponding one of said two of said storage members.

9. The modular organizer as claimed in claim 7, wherein said first storage member includes a bowl-shaped container body defining an accommodating chamber therein, and an openable top cover disposed pivotally on said container body for covering said accommodating chamber; and said second storage member having a top surface that is formed with a blind hole.

10. The modular organizer as claimed in claim 1, wherein each of said two of said storage members has a sleeve portion, said first and second positioning elements extending respectively through said sleeve portions of a corresponding one of said two of said storage members.

11. The modular organizer as claimed in claim 1, wherein the first and second positioning elements extend above the row of storage members such that the row of storage members are separated from the rod when the retaining hook portion engages the rod.

* * * * *